US009425540B2

(12) United States Patent
Schnurpfeil et al.

(10) Patent No.: US 9,425,540 B2
(45) Date of Patent: Aug. 23, 2016

(54) HOUSING FOR A CONTACT DEVICE

(71) Applicant: Tyco Electronics AMP GmbH, Bensheim (DE)

(72) Inventors: Thomas Schnurpfeil, Meckenheim (DE); Guenter Feldmeier, Lorsch (DE); Peter Kraemer, Grasellenbach (DE); Gregor Lindemann, Bensheim (DE); Ufuk Tuey, Mannheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 77 days.

(21) Appl. No.: 14/379,083

(22) PCT Filed: Feb. 14, 2013

(86) PCT No.: PCT/EP2013/052942

§ 371 (c)(1),
(2) Date: Aug. 15, 2014

(87) PCT Pub. No.: WO2013/120936

PCT Pub. Date: Aug. 22, 2013

(65) Prior Publication Data

US 2016/0020551 A1 Jan. 21, 2016

(30) Foreign Application Priority Data

Feb. 17, 2012 (DE) ..... 20 2012 001 638 U

(51) Int. Cl.
*H01R 13/52* (2006.01)
*H01R 13/516* (2006.01)
(Continued)

(52) U.S. Cl.
CPC ..... *H01R 13/5205* (2013.01); *H01R 13/506* (2013.01); *H01R 13/516* (2013.01);
(Continued)

(58) Field of Classification Search
CPC .. H01R 13/5205; H01R 13/582; H01R 24/60; H01R 13/506; H01R 13/6215
USPC ..... 439/271, 275, 277
See application file for complete search history.

(56) References Cited

U.S. PATENT DOCUMENTS

| | | | |
|---|---|---|---|
| 7,950,942 | B2 | 5/2011 | Klinger et al. |
| 2003/0100215 | A1 | 5/2003 | Bachman |

FOREIGN PATENT DOCUMENTS

| | | | |
|---|---|---|---|
| EP | 1075051 | A2 | 2/2001 |
| GB | 2311666 | A | 10/1997 |

(Continued)

OTHER PUBLICATIONS

International Search Report and Written Opinion issued by the European Patent Office, dated Apr. 5, 2013, for related International Application No. PCT/EP2013/052942; 13 pages.

*Primary Examiner* — Khiem Nguyen
(74) *Attorney, Agent, or Firm* — Faegre Baker Daniels LLP

(57) ABSTRACT

The invention relates to a housing (100) for a contact device (450) which can be fitted to a cable (480), having a first housing portion (101) for receiving the contact device (450) and a second housing portion (201) which can be arranged on the first housing portion (101). The first housing portion (101) has an inlet portion (150) for the cable (480) having a cable seal (350). The inlet portion (150) of the first housing portion (101) has a recess (160) which exposes an outer part-region of the cable seal (350). The second housing portion (201) can be arranged on the first housing portion (101) in such a manner that the second housing portion (201) can be pressed onto the outer part-region of the cable seal (350) via the recess (160) of the inlet portion (150) of the first housing portion (101). The invention further relates to an arrangement comprising a housing (100), a contact device (450) and a cable (480).

15 Claims, 9 Drawing Sheets

(51) Int. Cl.

| | |
|---|---|
| ***H01R 13/58*** | (2006.01) |
| ***H01R 13/506*** | (2006.01) |
| ***H01R 13/621*** | (2006.01) |
| ***H01R 24/60*** | (2011.01) |
| *H01R 24/64* | (2011.01) |

(52) U.S. Cl.

CPC ..... *H01R13/582* (2013.01); *H01R 13/5825* (2013.01); *H01R 13/6215* (2013.01); *H01R 24/60* (2013.01); *H01R 13/5219* (2013.01); *H01R 24/64* (2013.01)

(56) References Cited

FOREIGN PATENT DOCUMENTS

| | | |
|---|---|---|
| GB | 2461372 A | 1/2010 |
| WO | WO 96/08855 | 3/1996 |

HOUSING FOR A CONTACT DEVICE

BACKGROUND

The present invention relates to a housing for a contact device which can be fitted to a cable. The invention further relates to an arrangement comprising a housing, a contact device and a cable.

In order to connect cables to devices or appliances, contact devices are arranged at cable ends of the cables. The contact devices have contact elements which can be connected to lines or strands of the cables. A contact device is generally in the form of a so-called plug type connector which can be connected to a complementary mating connector. The contact elements of the plug type connector can thereby be brought into contact with corresponding contact elements of the mating connector. Possible constructions of plug type connectors are plugs and sockets or couplings.

In order to protect plug type connections from external influences such as in particular dust and fluids, housings provided with sealing systems are used to receive contact devices. This applies, for example, to plugs for data transmission cables used in the industrial sector. The sealing systems generally comprise two or more individual components. For example, an insertion side of a housing ("insertion face") may be protected with a first seal and a cable inlet, via which a cable is guided into the housing, may be protected with a separate second seal.

The assembly of conventional housings on contact devices may be associated with a relatively high level of complexity. In particular, the use of special tools may be necessary in order to bring about the desired sealing function.

SUMMARY

The object of the invention is to provide a solution for an improved housing for receiving a contact device.

This object is achieved by a housing according to claim 1 and by an arrangement according to claim 12. Other advantageous embodiments of the invention are set out in the dependent claims.

According to the invention, a housing is proposed for a contact device which can be fitted to a cable. The housing has a first housing portion for receiving the contact device and a second housing portion which can be arranged on the first housing portion. The first housing portion has an inlet portion for the cable having a cable seal. The inlet portion of the first housing portion has a recess which exposes an outer part-region of the cable seal. The second housing portion can be arranged on the first housing portion in such a manner that the second housing portion can be pressed onto the outer part-region of the cable seal via the recess of the inlet portion of the first housing portion.

The cable can be guided into the first housing portion via the inlet portion. In this instance, the cable may be surrounded or enclosed by the cable seal provided in this portion. A deformation, that is to say, a displacement and/or compression, of the cable seal can be brought about via the second housing portion which can be arranged on the first housing portion and which can be pressed onto the outer part-region of the cable seal exposed at that location via the recess of the inlet portion. It is thereby possible to have a reliable sealing of the inlet portion. The sealing function in the region of the cable inlet can be brought about in a relatively simple manner without the use of special tools in this instance.

In a preferred embodiment, the first and second housing portions have corresponding engaging structures, by means of which the second housing portion can be fixed to the first housing portion. The second housing portion can thereby be secured to the first housing portion in a relatively simple manner without tools. The corresponding engaging structures may be, for example, engaging recesses or engaging indentations and associated engaging projections or engaging springs.

In another preferred embodiment, the second housing portion can be arranged on the first housing portion in different positions so that there can be brought about a different pressing action on the outer part-region of the cable seal and thereby a different deformation of the cable seal. The housing thereby affords the possibility of achieving a reliable sealing of the inlet portion even with relatively great component tolerances. It is further possible for the housing to be able to be used for different cable dimensions or cable diameters. Unlike conventional housings, which are generally configured only for cables having a specific cable diameter or having cable diameters which differ only slightly, a high level of flexibility of use can thereby be provided.

With regard to different positions, consideration may further be given to the provision of a starting or basic position for the second housing portion on the first housing portion, in which no pressure is yet applied to the cable seal. On this basis, the second housing portion can be displaced or pressed into an additional position ("end position") in order to bring about the desired pressing action on the cable seal.

There is preferably provision, for the arrangement of the second housing portion on the first housing portion in different positions, for the second housing portion to have an engaging form and two engaging projections arranged opposite, and for the first housing portion to have at the outer side a plurality of engaging recesses for each engaging projection of the second housing portion. The engaging recesses may be constructed in particular so as to extend parallel with each other.

In another preferred embodiment, the second housing portion has a pressing structure for pressing on the outer part-region of the cable seal. A reliable pressing action, and thereby displacement or compression of the cable seal, can be brought about by means of the pressing structure which may have a form corresponding to the cable seal. The form of a hollow cylinder may particularly be considered for the cable seal. In this instance, the pressing structure may have a curved or part-circle-like contour.

In another preferred embodiment, the first and/or second housing portion has/have structural elements for pressing on the cable for tensile relief. The cable can thereby be securely retained on the housing. It is also possible to protect connections between lines of the cable and contact elements of the contact device from mechanical loading.

In another preferred embodiment, the first housing portion has an opening region for the contact device having an opening seal. The contact device received in the first housing portion may be accessible at the opening region or project out of the first housing portion. In the case of a plug type connection produced between the contact device and a complementary contact device, a sealing of the opening region of the housing can be brought about via the opening seal.

The housing can be constructed to be fixed to a device provided with the complementary contact device by means of screws. In that regard, there is preferably provision for the first housing portion to have passage portions in which screws which can be used to fix the housing can be or are received. In this instance, screw seals are arranged inside the passage portions in order also to be able to bring about a sealing action at those locations.

In another preferred embodiment, there is provision for the cable seal and the opening seal or the cable seal, the opening seal and the (optionally provided) screw seals to be mutually connected part-portions of a sealing member which is integrated in the first housing portion. The construction of the housing with such an integrated multifunctional sealing component allows a simple structure of the housing, whereby a simple assembly of the housing on a contact device and a cable can be (further) promoted. The first housing portion provided with the integrated sealing member can particularly be produced in the form of a two-component injection moulding member.

The integrated sealing member is preferably constructed from a silica gel, whereby a relatively high compression degree is available. It is thereby possible to obtain a secure sealing at those locations even with high dimensional tolerances at the cable inlet and at the opening region of the housing. A so-called dry silica gel which has a compression degree in the order of 60% and which can be deformed in all directions in a manner independent of the shape is preferably used. That compression degree is substantially higher than in conventionally used sealing materials. The most flexible sealing materials used in known housings are silicone materials, with which compression levels of (only) from 20% to 30% can be achieved.

In another preferred embodiment, the contact device which can be received in the first housing portion is a connector insert which can be arranged on a data transmission cable. In this instance, these may particularly involve an RJ45 connector insert. In order to fix the connector insert on the first housing portion, there may be provision for the first housing portion to have engaging recesses and for the connector insert to be constructed with projecting engaging elements.

According to the invention, there is further proposed an arrangement comprising a housing, a contact device and a cable. The housing has the above-described structure or a structure according to one of the above-described embodiments. In this instance, the contact device may be fitted to the cable and be received in the first housing portion. The cable can be guided via the inlet portion of the first housing portion into the first housing portion. The second housing portion can be (readily) arranged on the first housing portion and be pressed on the cable seal via the recess of the inlet portion. It is thereby possible to deform the cable seal, whereby the inlet portion of the first housing portion is securely sealed.

The above-explained advantageous embodiments and developments of the invention and/or those set out in the dependent claims may be used—except, for example, in cases of clear dependencies or non-combinable alternatives—individually or in any combination with each other.

BRIEF DESCRIPTION OF THE DRAWINGS

The invention is explained in greater detail below with reference to the Figures, in which.

DETAILED DESCRIPTION

One possible construction of a housing 100 for receiving a contact device 450 which can be connected to a cable 480 is described with reference to the following Figures. The housing 100 has a sealing system in the form of an integrated multifunctional sealing member 300 and can readily be mounted on the contact device 450 and the cable 480 without using a tool. The housing 100 provided with the sealing member 300 is distinguished in that relatively large component tolerances can be compensated for and a reliable flexible sealing can be allowed, in particular in the region of a cable inlet.

Figure 1:
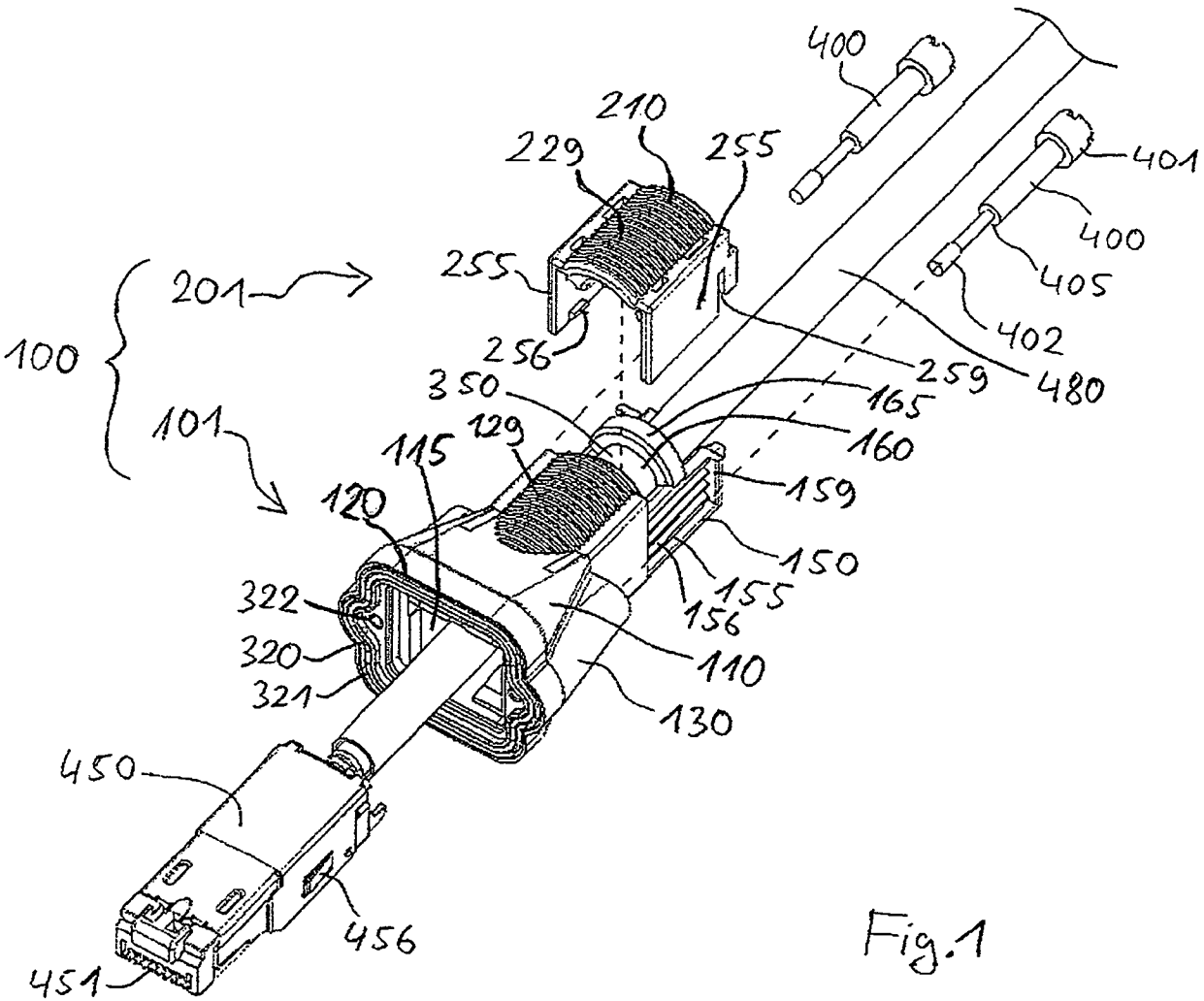
FIG. 1 is a perspective exploded view of a housing for receiving a connector insert which is connected to a cable.

FIG. 1 is a perspective exploded view of the housing 100 and the contact device 450 connected to the cable 480. The contact device 450 is in this instance an RJ45 connector (Registered Jack) which is in the form of a connector insert 450 and which has eight front-side contact elements 451. The associated cable 480 is a data transmission cable, for example, a network cable, whose individual lines or strands (not illustrated) are connected in a suitable manner to the contact elements 451 of the connector insert 450. The connector insert 450 is constructed to be inserted in a complementary contact device (RJ45 connector receptacle in the form of a socket or coupling) which can be provided on a corresponding device (not illustrated). The housing 100 serves in this instance to protect the produced plug type connection from external influences such as in particular dust and fluids. The housing 100 may comply with, for example, conditions according to the protection type IP65 or IP67 (Ingress Protection).

The housing 100 comprises, as illustrated in FIG. 1, a first and a second housing portion 101, 201 which are referred to below as the base portion 101 and actuation portion 201. The base portion 101 is constructed to receive the connector insert 450 fitted to the cable 480. The base portion 101 further has a cable inlet, via which the cable 480 is guided into the base portion 101. A reliable sealing action in the region of the cable inlet may—in conjunction with the integrated sealing member 300—be permitted by means of the actuation portion 201 which can be arranged on the base portion 101.

Figure 11:
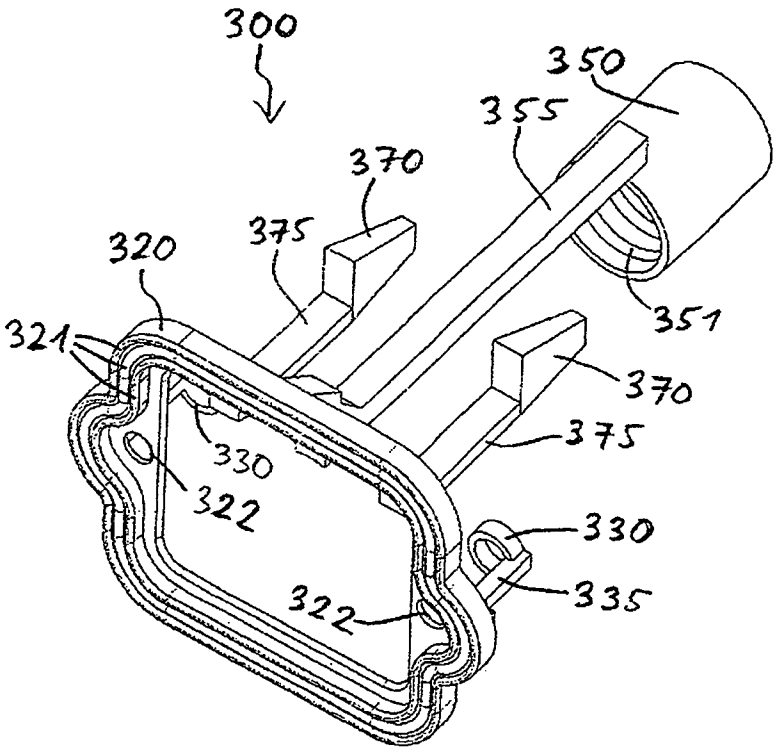
FIG. 11 is a perspective view of a sealing member of the housing.

The sealing member 300, of which FIG. 11 is a perspective individual view, is directly integrated in the base portion 101 of the housing 100. The sealing member 300 has a plurality of mutually connected sealing portions 320, 330, 350, 370 which may bring about a sealing action at different locations of the base portion 101 as will be described in greater detail below.

The base portion 101 with the integrated sealing member 300 may particularly be constructed in the form of a two-component injection moulding member. In this instance, the sealing member 300 may be constructed from a resilient sealing material and the (remaining) base portion 101 may be constructed from a different, more dimensionally stable material or plastics material. A silica gel, in particular a dry silica gel, may preferably be considered as the material for the sealing member 300. Such a material has a degree of compression in the order of 60% and can be deformed in all directions in a manner independent of the form. In such a construction, the sealing member 300 may be deformed at locations to be sealed, in particular at the cable inlet, in a relatively broad range by displacement and/or compression. It is thereby possible to overcome relatively great component tolerances and to provide a reliable seal.

Figure 2:
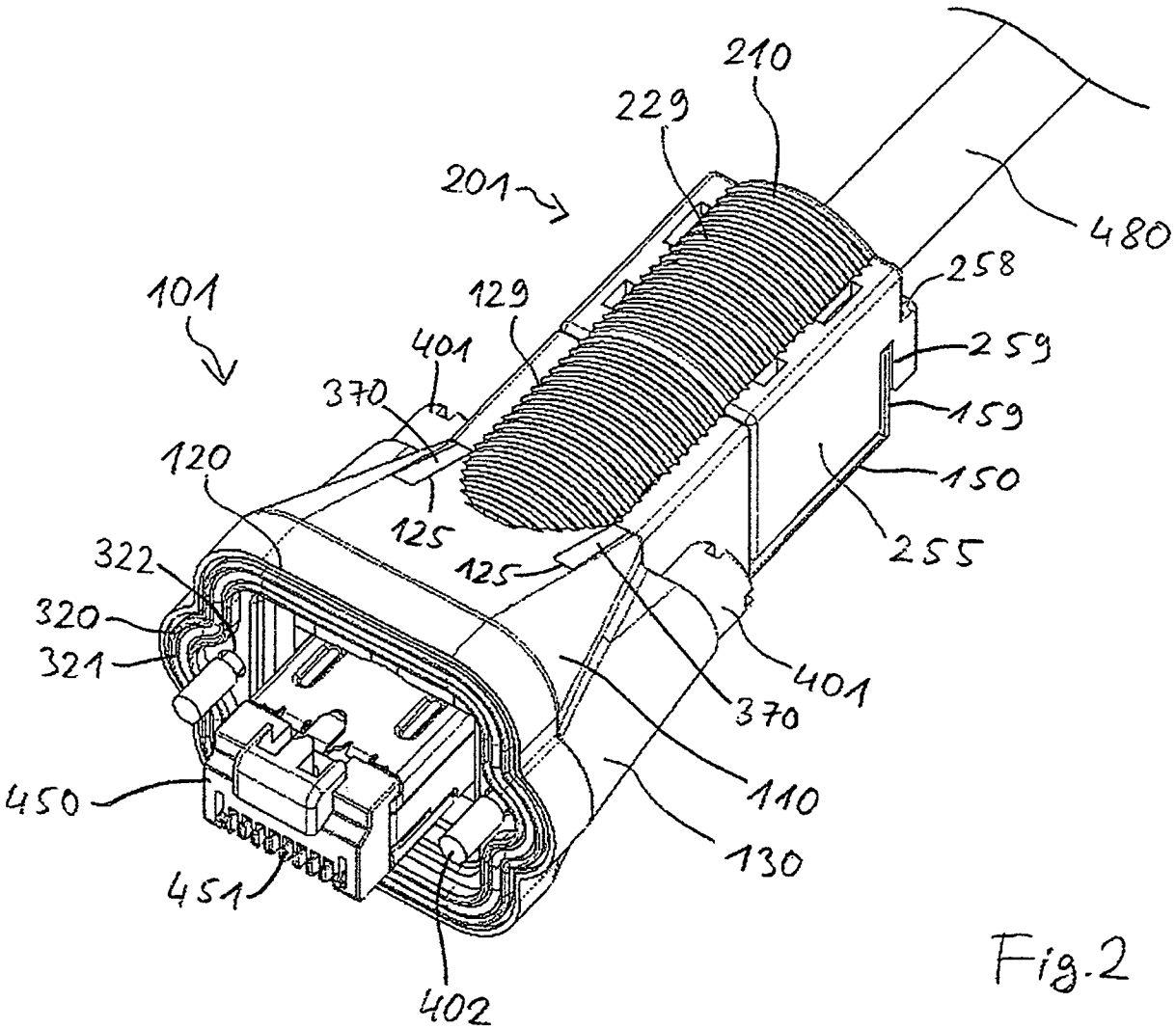
FIG. 2 is a perspective view of the housing with the connector insert received in the housing.

The base portion 101 comprises, as shown in FIGS. 1 to 4, a front-side receiving portion 110 for receiving the connector insert 450 and a rear-side inlet portion 150 which acts as a cable inlet. The receiving portion 110 surrounds a receiving space 115 and has, at the front side or insertion side of the base portion 101, an opening region 120 having an access opening for the receiving space 115. This is also shown in the sectional illustrations of the base portion 101 in FIGS. 6 and 7, which relate to the lines of section A-A and B-B indicated in FIG. 4. The receiving space 115 of the receiving portion 110 and the connector insert 450 have dimensions which correspond to each other so that the connector insert 450 can be (partially) inserted in the receiving space 115. In the assembled state of the housing 100 which is shown in FIG. 2, the connector insert 450 which is received in the receiving space 115 projects out of the base portion 101 at the opening region 120.

Figure 7:
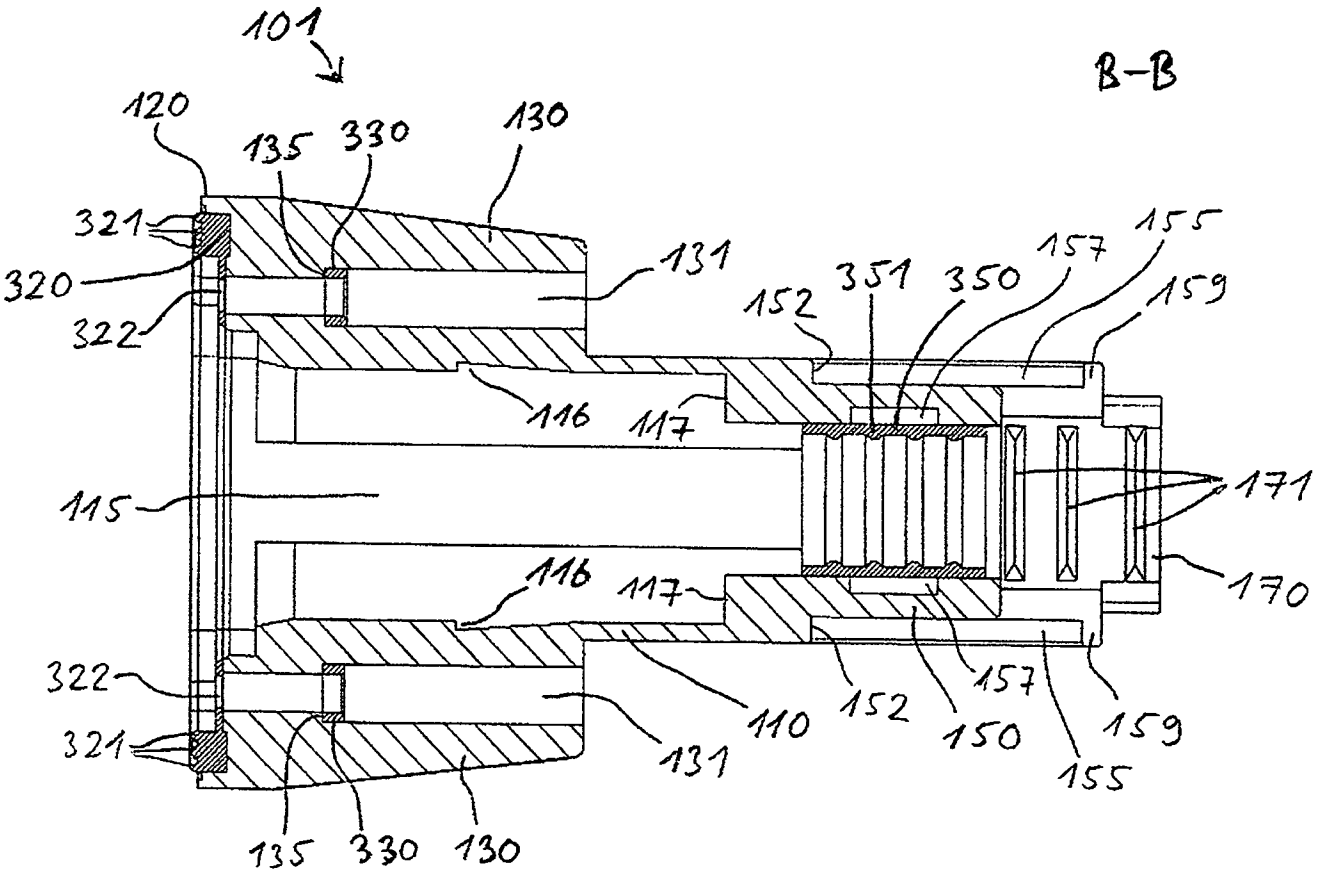

With reference to the sectional illustration of the base portion 101 of FIG. 7, it is further apparent that the receiving space 115 of the receiving portion 110 is constructed at opposing inner wall regions so as to have recesses 116. In a corresponding manner, the connector insert 450 has engaging elements or engaging springs 456 which project at two opposing side regions (cf. FIG. 1, here only visible for one side). The receiving space 115 is further constructed, as shown at 7, at one end so as to have step-like shoulders 117, which the connector insert 450 can abut in the inserted state. In this state, the engaging elements 456 of the connector insert 450 can further engage in the recesses 116 of the receiving space 115, whereby the connector insert 450 can be securely locked on the base portion 101.

Figure 5:
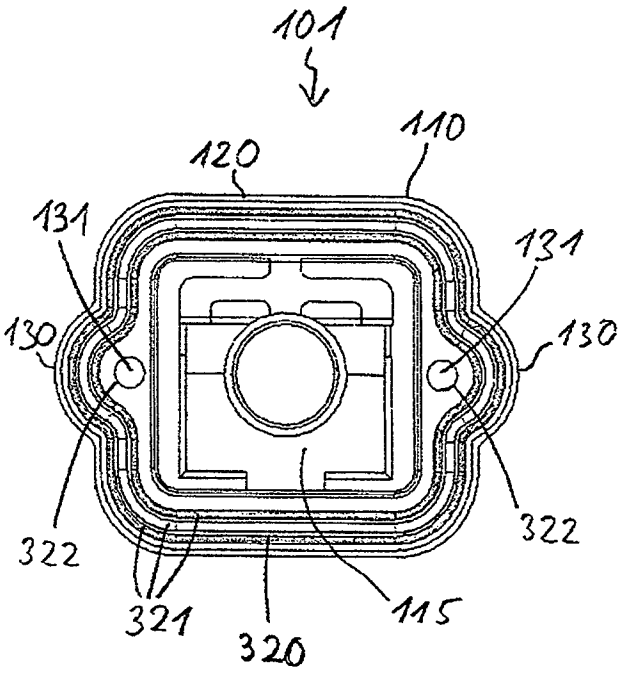
FIG. 5 is a view of an insertion side of the housing.

The receiving portion 110 of the base portion 101 further has passage portions 130 for receiving screws 400 in a front part-region, as illustrated in FIGS. 1 and 2, at two opposing sides. The passage portions 130 are constructed so as to have through-channels 131, as shown in FIG. 7, in which the screws 400 can be guided (introduced). The channels 131 extend (substantially) parallel with the receiving space 115 and have at the front side of the base portion 101 corresponding outlet openings which are arranged inside the opening region 120 (or an outer contour thereof). This is also apparent with reference to the front side or insertion side of the base portion 101 shown in FIG. 5. In the embodiment of the housing 100 illustrated in this instance, the opening region 120 has a substantially rectangular contour, the corners being rounded and two curved protrusions being provided in the region of the passage portions 130 arranged laterally at the receiving portion 110.

As illustrated in FIG. 1, the two screws 400 each comprise a head 401 (for example, having a cross-recessed structure) at one end and a thread 402 (for example, M2 thread) at an opposite end. A screw portion therebetween comprises two part-portions having different diameters so that a step-like shoulder 405 is provided. The channels 131 of the passage portions 130 having channel portions having different diameters are also adapted thereto and are therefore constructed so as to have a step-like shoulder 135 (cf. FIG. 7). The channels 131 are sealed in this region by means of the integrated sealing member 300, as will be described in greater detail below. When the screws 400 are in the state assembled on the base portion 101, the screws 400 project out of the base portion 101 with the thread 402, as illustrated in FIG. 2, at the opening region 120. In this instance, the heads 401 are located at an end of the passage portions 130 opposite the opening region 120.

The housing 100 or the base portion 101 thereof can be fixed by means of the screws 400 to a device which has the above-mentioned complementary contact device for the connector insert 450 and corresponding fixing structures or inner threads for the outer threads 402 of the screws 400 (not illustrated). Owing to the fixing action by means of the screws 400, it is possible to prevent the housing 100 from becoming detached in an undesirable manner from the device and thereby the plug type connection between the connector insert 450 and the complementary contact device from becoming separated in an undesirable manner.

In order to seal the housing 100 or base portion 101 in the inserted state between the connector insert 450 and the complementary contact device at the insertion side, the opening region 120 is provided with a sealing portion 320 of the integrated sealing member 300 which is referred to below as an opening seal 320. The opening seal 320 arranged at the edge of the opening region 120 has, as is apparent in particular with reference to FIGS. 4, 5 and 11, a peripheral form.

The opening seal 320 has an outer part-portion which comprises a plurality of sealing lips 321, in this instance three sealing lips (cf. FIG. 11). The outer part-portion of the opening seal 320 follows the contour of the opening region 120 or has the same contour (that is to say, rectangle with rounded corners and protrusions in the region of the passage portions 130, cf. FIGS. 4 and 5). The outer part-portion or the sealing lips 321 thereof project further (slightly) at the opening region 120 of the base portion 101 (cf. FIGS. 3, 6 and 7). The opening seal 320 further has an inner part-portion which is surrounded by the outer part-portion and a smaller thickness than the outer part-portion. The inner part-portion delimits a rectangular recess (having rounded corners) which corresponds to the through-opening of the receiving space 115 and is further constructed in the region of the passage portions 130 so as to have openings 322 corresponding to the channels 131 (cf. FIGS. 4, 5, 7 and 11). When the housing 100 is in the assembled state, therefore, the screws 400 received in the channels 131 of the passage portions 130 can extend through the openings 322 of the opening seal 320 (cf. FIG. 2).

In the context of the housing 100 being mounted by means of the screws 400 on a device having a complementary contact device, the opening seal 320 which is arranged at the opening region 120 and which has the sealing lips 321 can be pressed and correspondingly deformed on the device, for example, on a pressing region provided at that location or on a sealing face. The base portion 101 of the housing 100 can thereby be sealed at that location. The sealing relates to an axial direction (that is to say, relative to a longitudinal axis of the housing 100) and to a direction which is radial or perpendicular thereto. The above-described construction of the sealing member 300 and therefore the opening seal 320 comprising a silica gel, in particular dry silica gel, makes it possible for the opening seal 320 to be able to be flexibly deformed both on a planar sealing face but also on a different sealing contour such as, for example, a rough sealing face. In that manner, reliable sealing of the opening region 120 is possible and component tolerances can further be reliably compensated for. The achievement of a secure sealing action can further be promoted by the construction of the opening seal 320 so as to have the three sealing lips 321.

In the base portion 101 of the housing 100, the channels 131 provided for the introduction of the screws 400 adjoin the opening region 120 which can be sealed by means of the cable seal 320. So that this region can be protected from the introduction of dust and fluids via the channels 131, there are arranged in the channels 131 of the passage portions 130 additional sealing portions 330 of the sealing member 300 which are referred to below as screw type seals 330. The screw type seals 330, which are constructed in an annular or hollow-cylindrical manner, as shown in FIG. 11, are arranged in each of the two channels 131 inside the wider channel portion and so as to adjoin the step-like shoulder 135 (cf. FIG. 7).

In the case of the screws 400 received in the channels 131, the screws 400 are surrounded by the screw type seals 330 (FIG. 11), whereby the base portion 101 of the housing 100 can be sealed at those locations. The screw type seals 330 are between the shoulders 135 of the channels 131 and the shoulders 405 of the screws 400. When the housing 100 is in the state mounted on a device, therefore, the screw type seals 330 can be pressed together by means of the screws 400. In this instance, the construction of the sealing member 300 from silica gel or dry silica gel may also promote a reliable sealing action. In addition to the sealing function, the screw type seals 330 may further bring about a configuration in which the screws 400 are able to be retained on the base portion 101 (in the non-assembled state).

It can be seen with reference to FIG. 11 that the screw type seals 330 are connected to the opening seal 320 via connection webs 335. In a corresponding manner, the base portion 101 has a corresponding shape having through-regions for the connection webs 335 (not illustrated).

As already set out above, the base portion 101 of the housing 100 has an inlet portion 150 which acts as a cable inlet in a manner adjoining the receiving portion 110 (cf. FIGS. 1 to 4). The inlet portion 150 surrounds a passage region connected to the receiving space 115 of the receiving portion 110 so that the cable 480 can be guided into the base portion 101 and thereby to the connector insert 450.

In order to seal the inlet portion 150 of the base portion 101 at that location, an additional sealing portion 350 of the integrated sealing member 300 is provided at the passage region of the inlet portion 150 in a state adjoining the receiving space 115 and is referred to below as the cable seal 350 (cf. FIGS. 6 and 7). As illustrated in FIG. 11, the cable seal 350 has a hollow-cylindrical form. An outer side of the cable seal 350 is smooth in this instance and an inner side is constructed so as to have radially extending ribs or protrusions 351.

The cable 480 guided into the base portion 101 via the inlet portion 150 extends through the cable seal 350 (not illustrated). The cable 480, that is to say, an outer side or a covering of the cable 480 is therefore surrounded by the cable seal 350. For a reliable sealing of the inlet portion 150, the actuation portion 201 can be arranged on the inlet portion 150 of the base portion 101 in such a manner that the actuation portion 201 is pressed from the outer side on the cable seal 350 and compression and deformation of the cable seal 350 are thereby brought about. The actuation portion 201 can further be arranged in different positions on the inlet portion 150 of the base portion 101, whereby deformation of the cable seal 350 to different degrees can be brought about.

Figure 3:
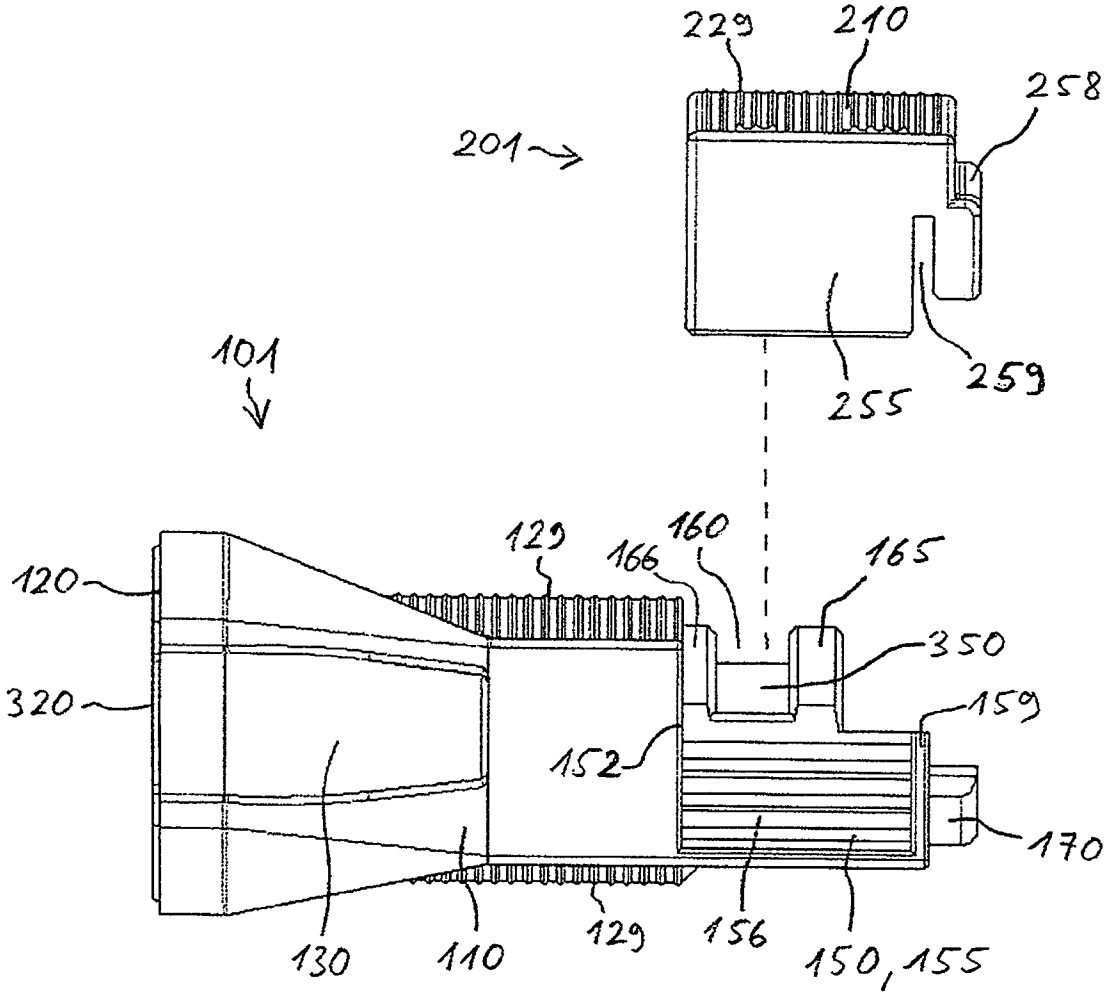
FIG. 3 is a side view of a base portion and an actuation portion of the housing in the disassembled state.
Figure 4:
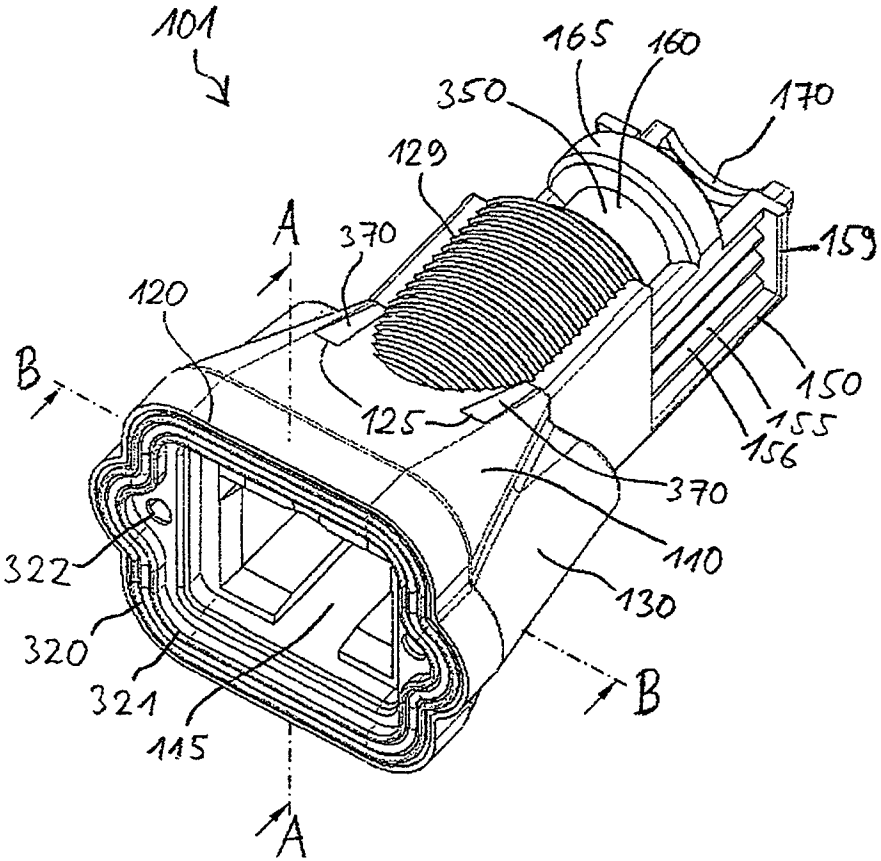
FIG. 4 is a perspective view of the base portion of the housing.
Figure 6:
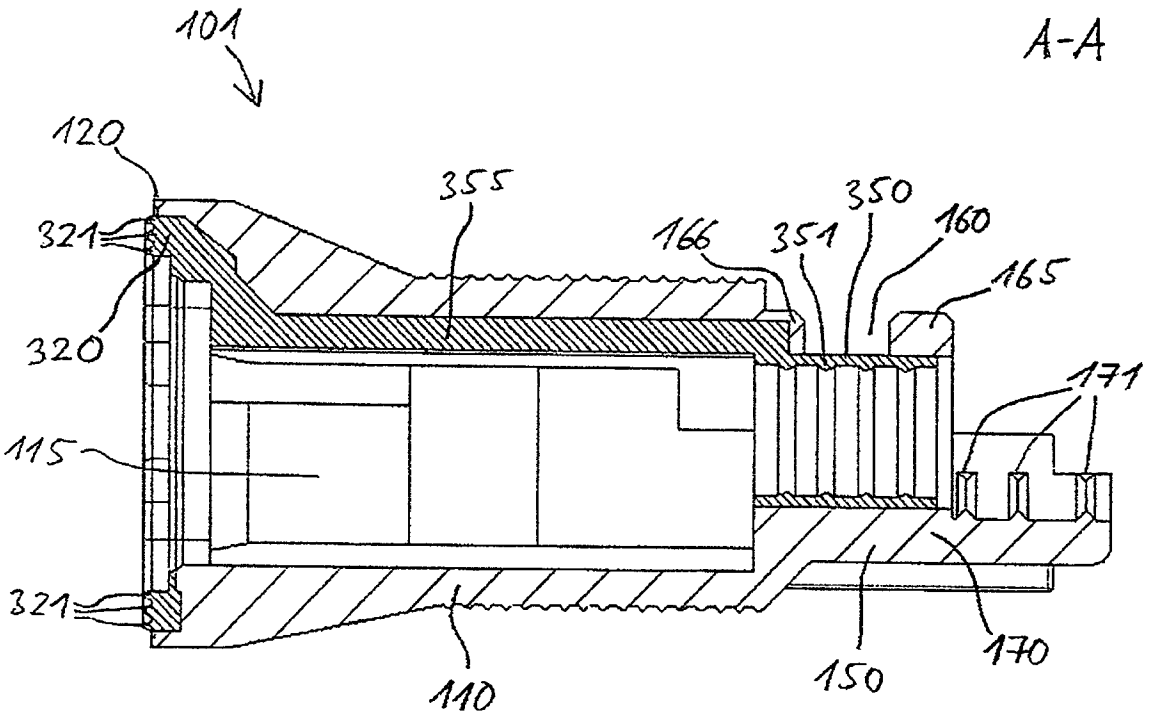
FIGS. 6 and 7 are different sectional views of the base portion of the housing.

For such operation, the inlet portion 150 of the base portion 101 is, as illustrated in FIGS. 3, 4 and 6, constructed at an upper side of the base portion 101 with a recess 160 in the region of the cable seal 350. The actuation portion 201 can be pressed on the cable seal 350 by means of the recess 160 which exposes a partial region of the (radial) outer face or outer side of the cable seal 350. The recess 160 is located between two curved part-portions 165, 166 of the inlet portion 150. The curved part-portions 165, 166 extend from two side portions 155 which are arranged at opposing sides of the inlet portion 150 or connect the side portions 155 to each other. The side portions 155 which are constructed, as described below, in order to fix the actuation portion 201 are further connected to a lower-side base portion 170 of the inlet portion 150 or merge into the base portion 170 (cf. FIGS. 6 and 7). At a rear end, the base portion 170 projects beyond the side portions 155 (cf. FIG. 3). The curved shape of the part-portions 165, 166 corresponds to the cylindrical form of the cable seal 350. A correspondingly curved inner contour may also be provided in the region of the side portions 155 and the base portion 170.

The actuation portion 201 which can be arranged on the inlet portion 150 of the base portion 101 and which can be constructed from a dimensionally stable plastics material has, as shown in FIG. 1, a structure which corresponds to the inlet portion 150 and which has a surrounding shape. The actuation portion 201 has two lateral wall portions 255, a central portion 210 which connects the wall portions 255, and an end portion 258 at a rear end (cf. FIG. 3). In a lower part-region, the two lateral wall portions 255 have, as indicated in FIG. 1, at the inner sides two hook-like engaging projections 256 which are arranged opposite. This is also apparent with reference to the sectioned illustration of FIG. 9, in which the actuation portion 201 mounted on the inlet portion 150 of the base portion 101 is illustrated.

Figure 9:
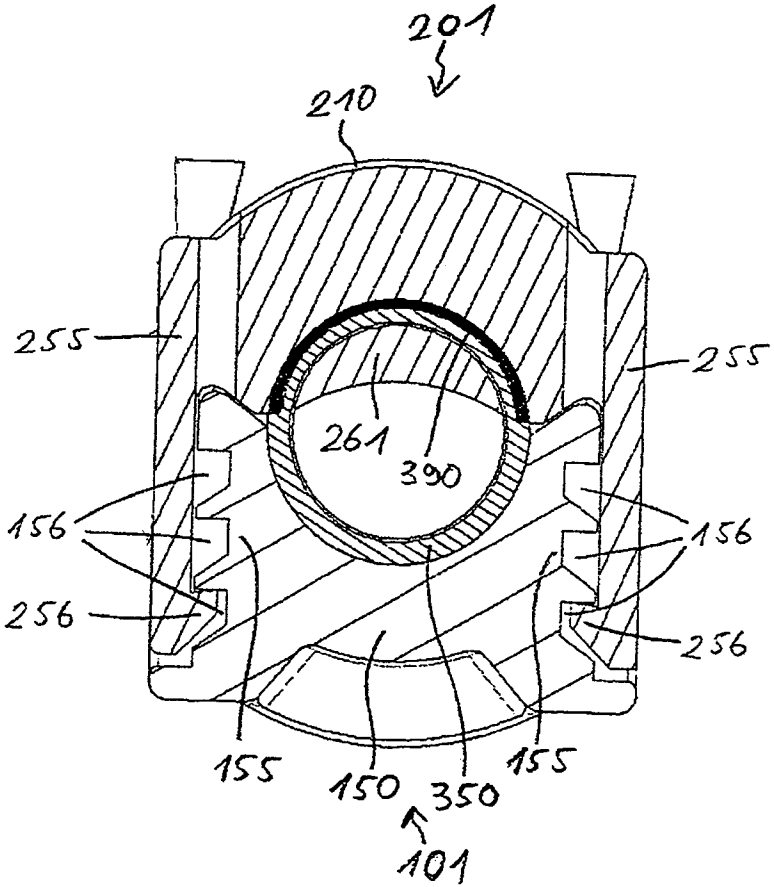
FIGS. 9 and 10 are different sectional views of the base portion and the actuation portion of the housing, which actuation portion is arranged on the base portion.

In a manner corresponding to the engaging projections 256 of the actuation portion 201, the side portions 155 of the inlet portion 150 of the base portion 101 have at the outer side a plurality of engaging recesses 156 which are arranged at different heights or which extend parallel with each other, and in which the engaging projections 256 can engage (cf. FIGS. 4 and 9). In the present embodiment of the housing 100, three engaging recesses 156 arranged one above the other are provided per side portion 155. It is thereby possible to fix the actuation portion 201 to the inlet portion 150 of the base portion 101 in three different engaging positions.

Figure 8:
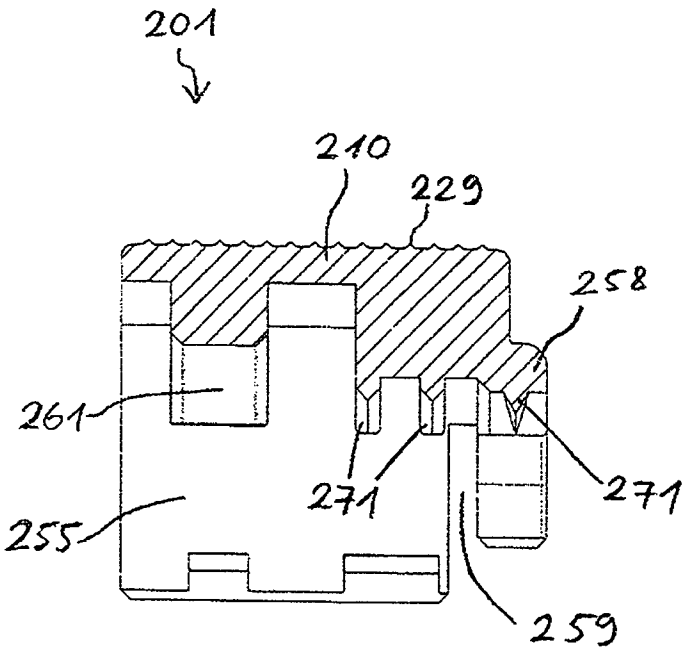
FIG. 8 is a sectional side view of the actuation portion of the housing.

The actuation portion 201 which can be locked on the inlet portion 150 of the base portion 101 further has, as shown in the sectional side view of FIG. 8, a pressing structure 261, by means of which the pressing on the (partially exposed) cable seal 350 from the outer side can be brought about. The web-like or plate-like pressing structure 261 is arranged at the inner side of the surrounding actuation portion 201 and can extend between the central portion 210 and the lateral wall portions 255. The pressing structure 261 further has a contour which is curved in the manner of a part-circle (cf. FIG. 9).

The actuation portion 201 can be arranged at the inlet portion 150 of the base portion 101 in such a manner that the pressing structure 261 is pressed on the outer-side part-region of the cable seal 350 exposed at that location via the recess 160 of the inlet portion 150, and is thereby pressed into the cable seal 350. In that manner, a corresponding displacement and/or compression of the cable seal 350 can be brought about, whereby the inlet portion 150 of the base portion 101 can be sealed with the cable 480 which is received here. The sectioned illustration of FIG. 9 illustrates an associated (semi-circular or part-circle-like) pressing region and therefore compression region 390 during pressing of the cable seal 350. For reasons of clarity, the cable seal 350 in FIG. 9—and also in the corresponding sectioned side view of FIG. 10—is shown only in a non-compressed state.

As described above, the actuation portion 201 can be arranged in (three) different engaging positions or heights at the inlet portion 150 of the base portion 101. The actuation portion 201 can initially be moved into a first engaging position, in which the engaging projections 256 engage in the engaging recesses 156 which are located in the uppermost position. Taking that as a basis, the actuation portion 201 can be pressed (gradually) into a lower position, in which the engaging projections 256 engage in engaging recesses 156 located in a lower position. When the actuation portion 201 is positioned on the inlet portion 150 of the base portion 101 and when the actuation portion 201 is "displaced" from one engaging position to the next, the actuation portion 201 is bent apart or the lateral wall portions 255 thereof are bent apart. In order to facilitate this operation, the hook-like engaging projections 256 of the actuation portion 201 and the engaging recesses 156 of the inlet portion 150 are, as shown in FIG. 9, constructed so as to have contours which extend in a (partially) inclined manner.

By different engaging positions being provided for the actuation portion 201, it is possible to bring about a different compression depending on the position of the actuation portion 201 and therefore displacement or compression of the cable seal 350. In that manner, a reliable sealing of the inlet portion 150 can be achieved even with relatively great component tolerances. It is further possible to use cables 480 having different cable dimensions or diameters, a reliable sealing action being able to be produced by arranging the actuation portion 201 in an associated engaging position. A high level of flexibility of use of the housing 100 results.

With regard to the different engaging positions of the actuation portion 201 on the base portion 101, there may be provision for the first engaging position, in which the engaging projections 256 engage in the engaging recesses 156 which are located in the uppermost position, to constitute an initial or basic position, in which compression of the cable seal 350 by the pressing structure 261 does not (yet) take place. Taking that as a basis, the actuation portion 201 can be pressed into a lower position in order to bring about a pressing action on the cable seal 350 and thereby a deformation thereof.

In the embodiment of the housing 100 shown here, the actuation portion 201 can be moved from the basic position by being pressed into a first "deformation position", with resultant deformation of the cable seal 350 and—where possible—by being further pressed into a second "deformation position" with a correspondingly larger or maximum deformation of the cable seal 350. In FIG. 9, but also in FIGS. 2 and 10, the second "deformation position" is illustrated with a positioning of the actuation portion 201 on the lower-most engaging recesses 156 of the inlet portion 150, whereby the maximum deformation of the cable seal 350 can be brought about.

It is further indicated in FIG. 7 that each side portion 155 of the inlet portion 150 can be constructed so as to have an additional recess 157 at the inner side or adjoining the cable seal 350. By means of the recess 157, whose length (in relation to the longitudinal axis of the housing 100) is smaller than the length of the cable seal 350, an additional (radial) free space can be provided in order to receive a portion of the (deformed) cable seal 350, whereby the sealing action may optionally be improved. In place of separate recesses 157 at the side portions 155, there may also be provision for one common recess 157 which extends partially round the cable seal 350 and which extends at the inner side of the side portions 155 and the base portion 170 which is arranged therebetween.

In particular in the cable seal 350, the construction of the sealing member 300 from silica gel or dry silica gel has been found to be advantageous. Owing to the high degree of compression of this material (approximately 60%), an extensive deformation of the cable seal 350 can be brought about by means of the actuation portion 201, whereby a secure sealing of the inlet portion 150 of the base portion 101 is possible. The construction of the cable seal 350 with the inner-side ribs or projections 351 may further promote the sealing action.

It is apparent with reference to FIG. 11 that the cable seal 350 provided in the region of the inlet portion 150 is connected to the opening seal 320 via a (an additional) connection web 355. In a corresponding manner, the base portion 101 has a form which corresponds thereto and which has a passage region for the connection web 355 (cf. FIGS. 6, 10).

In order to facilitate the arrangement of the actuation portion 201 used to deform the cable seal 350 on the inlet portion 150 of the base portion 101, the two side portions 155 of the inlet portion 150 are, as shown in FIGS. 1 to 4, constructed so as to have a projecting guiding structure or guiding wall 159 at one end of the engaging recesses 156. At an end opposite it or at the transition between the inlet portion 150 and the receiving portion 110 of the base portion 101, there is a step-like shoulder 152 (cf. FIG. 7). The actuation portion 201 has recesses 259 which correspond to the guiding walls 159 in a region between the lateral wall portions 255 and the end portion 258, in which the guiding walls 159 can be received (cf. FIGS. 2 and 3). It is thereby possible to predetermine an orientation for the positioning of the actuation portion 201 on the inlet portion 150 of the base portion 101 and to guide the actuation portion 201 accordingly during downward pressing or movement into the engaging positions on the inlet portion 150. An additional guiding action can also be obtained via the shoulders 152 of the inlet portion 150 which may act as a delimitation for the wall portions 255 of the actuation portion 201 (or the edges thereof in the region of the shoulders 152).

As indicated in FIG. 3, the end portion 258 of the actuation portion 201 has at an upper side a part-region which is offset in a step-like manner relative to the central portion 210 and which has a curved or bent shape. When the actuation portion 201 is in the state mounted on the inlet portion 150 of the base portion 101, the cable 480 may be surrounded in this region (substantially) by the end portion 258 and the base portion 170 which is also of curved form (cf. FIG. 4).

Figure 10:
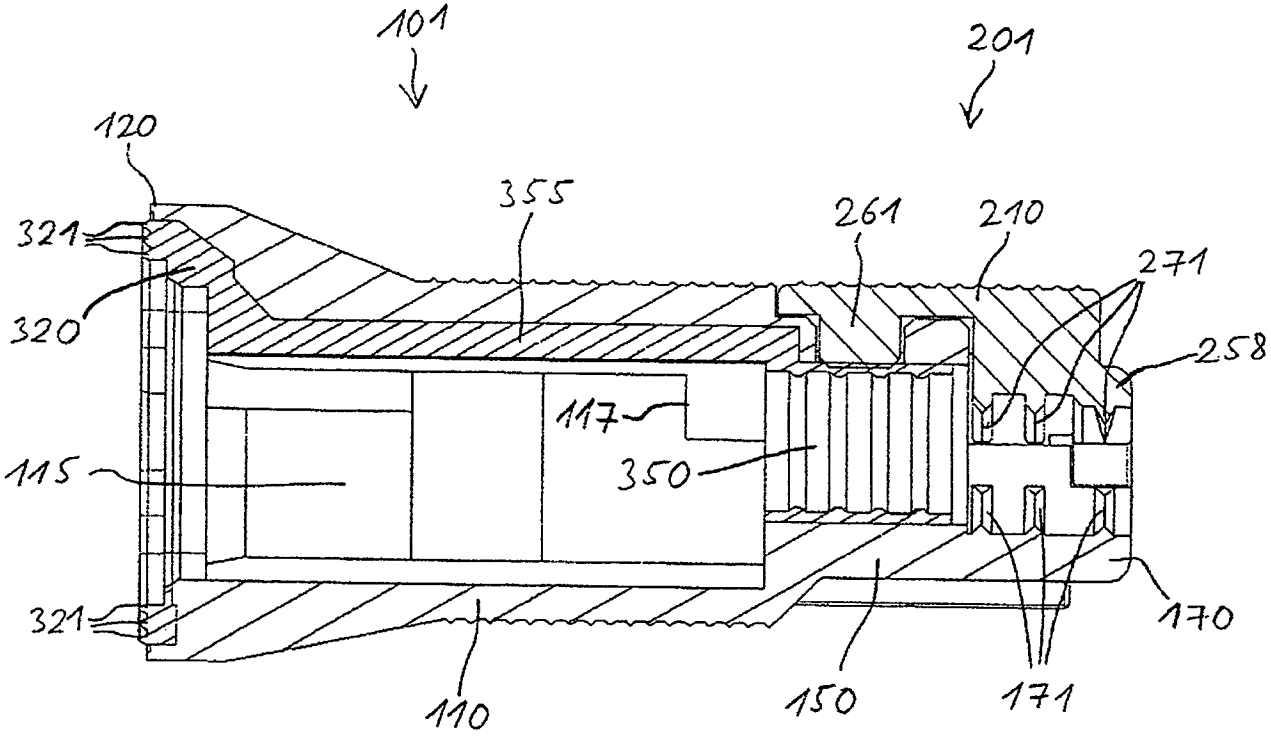

The actuation portion 201 is further constructed, together with the inlet portion 150 of the base portion 101, to allow tensile relief for the cable 480. For this purpose, the actuation portion 201 has at the inner side a plurality of projecting structural elements 271 (three in this instance), as shown in FIGS. 8 and 10. One of the structural elements 271 is provided in the region of the end portion 258 of the actuation portion 201. The inlet portion 150 of the base portion 101 has, in a manner corresponding thereto, as illustrated in FIGS. 6, 7 and 10, a plurality of projecting structural elements 171 (also three in this instance). The structural elements 171 are constructed on the base portion 170 which is connected to the side portions 155. When the actuation portion 201 is in the state mounted on the base portion 101, the cable 480 (or the covering thereof) can be clamped by means of the mutually opposing structural elements 171, 271, whereby tensile relief is brought about. The cable 480 can thereby be securely retained on the housing 100 and connections between the lines or strands of the cable 480 and the connector insert 450 can be protected from mechanical loading.

The sealing member 300 shown in FIG. 11 has, in addition to the sealing portions 320, 330, 350 already described, additional sealing portions 370 which are also connected to the opening seal 320 via connection webs 375. As indicated in FIGS. 2 and 4, the receiving portion 110 of the base portion 101 is constructed in the region of the upper side so as to have recesses 125 in which the additional sealing portions 370 are arranged. The recesses 125 which extend as far as the receiving space 115 are provided on the base portion 101 for technical production reasons. A tool used in the context of the injection moulding of the base portion 101 can be guided through the recesses 125 in this instance in order to fix the form of the recesses 116 of the receiving space 115 (cf. FIG. 7). The recesses 125 can reliably be sealed by means of the sealing portions 370. The base portion 101 also has corresponding passage regions (not illustrated) for the associated connection webs 375.

The components of the housing 100 are constructed so as to have additional structures in order to allow simple handling after assembly has been completed. For example, the central portion 210 of the actuation portion 201 is constructed at the upper side so as to have ribs 229. The base portion 101 is also constructed at the upper side and at an opposing lower side so as to have ribs 129 (cf. FIGS. 1 to 3).

The assembly of the housing 100 on the connector insert 450 and the cable 480 can be carried out without tools and in a relatively simple manner. This becomes evident from an exemplary assembly of those components described below.

During assembly, the cable 480 is introduced into the base portion 101 via the inlet portion 150 (and the cable seal 350 provided at that location) and directed out of the base portion 101 again via the opening region 120 so that an end portion of the cable 480 projects out of the base portion 101. The actuation portion 201 may in this instance already be preassembled on the base portion 101 in a basic position in which the cable seal 350 is not compressed. The screws 400 may also already be arranged on the base portion 101.

Afterwards, the lines or strands of the cable 480 are exposed at the cable end, which can be brought about by removing a portion of the cable covering (and optionally a portion of other cable components, for example, a shielding). The strands of the cable 480, which can be surrounded by individual insulation members, are subsequently connected to the connector insert 450 or the contact elements 451 thereof.

For this purpose, the connector insert 450 may have, for example, two part-portions, apart-portion being constructed with the contact elements 451 and cutting clamps connected thereto. By the strands being positioned in the cutting clamps and the part-portions of the connector insert 450 being joined, the insulation members of the strands can be separated and electrical connections can be produced. This operation may also be carried out without tools. The part-portions of the connector insert 450 can be connected to each other, for example, via a hinge or articulation and be joined together by being folded together. A shielding of the cable 480 which may be present is further connected to the connector insert 450 in a suitable manner.

Subsequently, the connector insert 450 arranged at the cable end is pushed via the opening region 120 into the receiving space 115 of the base portion 101 until the connector insert 450 adjoins the shoulders 117 of the receiving space 115 and the engaging elements 456 engage in the recesses 116 of the receiving space 115. Subsequently, the actuation portion 201 can be moved into one of the two different "deformation positions" by being pressed manually, whereby the housing 100 is sealed at that location.

The components explained with reference to the Figures are preferred or exemplary embodiments of the invention. Besides the embodiments described and illustrated, it is also possible to envisage other embodiments which may comprise other developments or combinations of features. In particular, a base portion 101 and an actuation portion 201 which can be arranged thereon can be constructed so as to have other forms and structures.

For example, a different number or greater number of engaging recesses 156 can be provided on a base portion 101 so that a different number or greater number of fixing positions are provided for an actuation portion 201 having engaging projections 256 on the base portion 101. It is also possible to construct a base portion 101 so as to have engaging projections 256 and an (a surrounding) actuation portion 201 so as to have engaging recesses. It is further possible to provide other engaging structures, for example, flexible engaging springs in place of engaging projections 256.

Another possible modification involves the provision of not only one guiding wall 159 and one recess 259 but instead a plurality of guiding walls 159 and recesses 259, for example two, in order to guide an actuation portion 201 on a base portion 101 (per side). Furthermore, other guiding structures can also be constructed for guiding.

Other forms can further be considered, for example, for a pressing structure 261 of an actuation portion 201. It is further possible to provide structural elements 171, 271 for tensile relief only on a base portion 101 or alternatively only on an actuation portion 201. Another variant involves a base portion 101, on which no screws 400 are provided and which is therefore also constructed without passage portions 130 and cable seals 330.

A multifunctional integrated sealing element or such a sealing member 300 may also have a structure other than the structure shown and described. It is further possible to provide a plurality of separate sealing members or sealing portions in place of a single multifunctional sealing member. These sealing portions may also be constructed so as to be integrated on a base portion 101, the base portion 101 again being able to be a two-component injection moulding member. A silica gel, in particular a dry silica gel, can also be used as a sealing material in this instance, respectively. This particularly relates to a (separate) cable seal 350 arranged on an inlet portion 150 of a base portion 101.

It is further conceivable for a housing 100 constructed according to the above principles to be usable or to be able to be constructed not only to receive an RJ45 connector insert 450 but also to receive other contact devices 450. This may include contact devices having a different structure and/or from different technical fields (that is to say, other than the field of data transmission or telecommunications).

The invention claimed is:

1. A housing for a contact device which can be fitted to a cable, having:

a first housing portion for receiving the contact device; and a second housing portion which can be arranged on the first housing portion, wherein the first housing portion has an inlet portion for the cable having a cable seal, wherein the inlet portion of the first housing portion has a recess which exposes an outer part-region of the cable seal, and wherein the second housing portion can be arranged on the first housing portion in such a manner that the second housing portion can be pressed onto the outer part-region of the cable seal via the recess of the inlet portion of the first housing portion, and wherein the second housing portion is configured to be arranged on the first housing portion in different positions so that there can be brought about a different pressing action on the outer part-region of the cable seal.

2. A housing according to claim 1, wherein the first and second housing portions have corresponding engaging structures, by means of which the second housing portion can be fixed to the first housing portion.

3. A housing according to claim 1, wherein the second housing portion can be arranged on the first housing portion in a basic position, in which no pressure is applied to the cable seal, and wherein the second housing portion is configured to be displaced from the basic position into an additional position on the first housing portion in order to bring about a pressing action on the cable seal.

4. A housing according to claim 1, wherein the second housing portion has an engaging form and two engaging projections arranged opposite, and wherein the first housing portion has at the outer side a plurality of engaging recesses for each engaging projection of the second housing portion.

5. A housing according to claim 1, wherein the second housing portion has a pressing structure for pressing on the outer part-region of the cable seal.

6. A housing according to claim 1, wherein the first and/or second housing portion has/have structural elements for pressing on the cable for tensile relief.

7. A housing according to claim 1, wherein the first housing portion has an opening region for the contact device having an opening seal.

8. A housing according to claim 1, wherein the first housing portion has passage portions in which screws which can be used to fix the housing can be received, and wherein screw seals are arranged inside the passage portions.

9. A housing according to claim 7, wherein the cable seal and the opening seal or the cable seal, the opening seal and the screw seals are mutually connected part-portions of a sealing member which is integrated in the first housing portion.

10. A housing according to claim 9, wherein the sealing member is constructed from a silica gel.

11. A housing according to claim 1, wherein the contact device which can be received in the first housing portion is a connector insert which can be arranged on a data transmission cable.

12. A housing according to claim 11, wherein the connector insert is an RJ-45 connector insert.

13. An arrangement, comprising:

a contact device;

a housing for the contact device; and a cable configured to be fitting with the contact device, wherein the housing includes:

a first housing portion for receiving the contact device; and a second housing portion which can be arranged on the first housing portion, wherein the first housing portion has an inlet portion for the cable having a cable seal, wherein the inlet portion of the first housing portion has a recess which exposes an outer part-region of the cable seal, and wherein the second housing portion can be arranged on the first housing portion in such a manner that the second housing portion can be pressed onto the outer part-region of the cable seal via the recess of the inlet portion of the first housing portion, and wherein the second housing portion is configured to be arranged on the first housing portion in different positions so that there can be brought about a different pressing action on the outer part-region of the cable seal.

14. A housing according to claim 5, wherein the cable seal has a hollow cylindrical form, and wherein the pressing structure has as curved contour.

15. A housing according to claim 1, wherein the cable seal has a hollow cylindrical form, and wherein the recess exposes a partial region of a radial outer side of the cable seal.

* * * * *